US011028764B2

(12) United States Patent
Park et al.

(10) Patent No.: US 11,028,764 B2
(45) Date of Patent: Jun. 8, 2021

(54) VEHICLE THERMAL MANAGEMENT SYSTEM APPLYING AN INTEGRATED THERMAL MANAGEMENT VALVE AND A COOLING CIRCUIT CONTROL METHOD THEREOF

(71) Applicants: HYUNDAI MOTOR COMPANY, Seoul (KR); KIA MOTORS CORPORATION, Seoul (KR)

(72) Inventors: Cheol-Soo Park, Yongin-si (KR); Dae-Kwang Kim, Yongin-si (KR); Dong-Suk Chae, Seoul (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 16/816,786

(22) Filed: Mar. 12, 2020

(65) Prior Publication Data

US 2021/0123372 A1 Apr. 29, 2021

(30) Foreign Application Priority Data

Oct. 25, 2019 (KR) ..... 10-2019-0133839

(51) Int. Cl.
*F01P 7/14* (2006.01)
*F01P 3/02* (2006.01)
(Continued)

(52) U.S. Cl.
CPC ..... *F01P 7/14* (2013.01); *F01P 3/20* (2013.01); *F01P 5/10* (2013.01);
(Continued)

(58) Field of Classification Search
CPC ..... F01P 3/02; F01P 2007/146; F01P 3/20; F01P 3/00
See application file for complete search history.

(56) References Cited

U.S. PATENT DOCUMENTS 6,668,764 B1 12/2003 Henderson
9,188,051 B1 11/2015 Zahdeh
(Continued)

FOREIGN PATENT DOCUMENTS

JP 2013024110 A 2/2013
JP 2018119423 A 8/2018
JP 2018178797 A 11/2018

*Primary Examiner* — Long T Tran
(74) *Attorney, Agent, or Firm* — Lempia Summerfield Katz LLC

(57) ABSTRACT

A vehicle thermal management system includes an Integrated Thermal Management Valve (ITM) for receiving engine coolant through a coolant inlet connected to an engine coolant outlet of an engine, and for distributing the engine coolant flowing out toward a radiator through a coolant outlet flow path connected to a heat exchange system. The heat exchange system includes at least one among a heater core, an Exhaust Gas Recirculation (EGR) cooler, an oil warmer, an Auto Transmission Fluid (ATF) warmer, and the radiator. The thermal management system includes a water pump positioned at the front end of the engine coolant inlet of the engine and a coolant branch flow path branched at the front end of an engine coolant inlet to be connected to the coolant outlet flow path.

18 Claims, 8 Drawing Sheets

(51) Int. Cl.
*F01P 5/10* (2006.01)
*F01P 3/20* (2006.01)

(52) U.S. Cl.
CPC ..... *F01P 2007/146* (2013.01); *F01P 2025/30* (2013.01); *F01P 2025/32* (2013.01); *F01P 2025/50* (2013.01); *F01P 2037/02* (2013.01)

(56) References Cited

U.S. PATENT DOCUMENTS

| | | | | |
|---|---|---|---|---|
| 9,649,909 | B2 | 5/2017 | Enomoto | |
| 9,850,802 | B2 | 12/2017 | Amano et al. | |
| 10,040,335 | B2 | 8/2018 | Zahdeh | |
| 10,161,292 | B1 | 12/2018 | Park | |
| 10,227,910 | B2 | 3/2019 | Kaneko | |
| 10,232,702 | B2 | 3/2019 | Nishikawa | |
| 10,279,656 | B2 | 5/2019 | Quix | |
| 2005/0000473 | A1 | 1/2005 | Ap | |
| 2006/0185364 | A1 | 8/2006 | Chalgren | |
| 2011/0023796 | A1 | 2/2011 | Cattani | |
| 2012/0067545 | A1 | 3/2012 | Yamazaki | |
| 2012/0111956 | A1 | 5/2012 | Kinomura | |
| 2012/0160447 | A1 | 6/2012 | Kinomura | |
| 2013/0213324 | A1 | 8/2013 | Saitoh | |
| 2013/0213600 | A1* | 8/2013 | Saitoh | F01P 7/16 165/11.1 |
| 2013/0243600 | A1 | 9/2013 | Noble | |
| 2013/0305708 | A1 | 11/2013 | Zahdeh | |
| 2015/0159540 | A1* | 6/2015 | Misumi | F01P 3/02 123/41.44 |
| 2016/0003127 | A1 | 1/2016 | Sakagawa | |
| 2016/0084142 | A1 | 3/2016 | Gooden | |
| 2016/0169081 | A1 | 6/2016 | Hosokawa | |
| 2016/0258341 | A1 | 9/2016 | Yoon | |
| 2016/0258343 | A1 | 9/2016 | Mushiga | |
| 2016/0341100 | A1 | 11/2016 | Nagai | |
| 2016/0348568 | A1 | 12/2016 | Kanefsky | |
| 2016/0363038 | A1* | 12/2016 | Kawamoto | F02M 26/28 |
| 2017/0074152 | A1* | 3/2017 | Woo | F02F 1/10 |
| 2017/0074154 | A1* | 3/2017 | Kaneko | F01P 11/18 |
| 2017/0159545 | A1 | 6/2017 | Onishi | |
| 2017/0184008 | A1 | 6/2017 | Nagai | |
| 2017/0253104 | A1* | 9/2017 | Amano | B60H 1/00314 |
| 2017/0298860 | A1* | 10/2017 | Mori | F01P 3/02 |
| 2017/0361698 | A1 | 12/2017 | Hussain | |
| 2017/0370271 | A1* | 12/2017 | Lee | F02F 1/14 |
| 2017/0370272 | A1* | 12/2017 | Koguchi | F01P 7/16 |
| 2018/0230893 | A1* | 8/2018 | Sato | F01P 7/161 |
| 2018/0298806 | A1 | 10/2018 | Sutherland | |
| 2018/0347445 | A1* | 12/2018 | Kaneko | F01P 3/20 |
| 2019/0010857 | A1* | 1/2019 | Kaneko | F01P 5/10 |
| 2019/0093546 | A1 | 3/2019 | Takagi | |
| 2019/0120178 | A1* | 4/2019 | Park | F02D 41/0077 |
| 2019/0152343 | A1 | 5/2019 | Onozawa | |
| 2019/0178148 | A1* | 6/2019 | Yi | F16K 3/26 |
| 2019/0186497 | A1 | 6/2019 | Lee | |

* cited by examiner

VEHICLE THERMAL MANAGEMENT SYSTEM APPLYING AN INTEGRATED THERMAL MANAGEMENT VALVE AND A COOLING CIRCUIT CONTROL METHOD THEREOF

CROSS-REFERENCE TO RELATED APPLICATION

This application claims priority to Korean Patent Application No. 10-2019-0133839, filed on Oct. 25, 2019, which is incorporated herein by reference in its entirety.

BACKGROUND OF THE DISCLOSURE

Field of the Disclosure

The present disclosure relates to a vehicle thermal management system, and in particular, to a cooling circuit of a vehicle thermal management system. The cooling circuit of the vehicle thermal management system uses the coolant flow rate of an exhaust heat recovery system for a variable separation cooling control of an integrated thermal management valve. This shortens the fast warm-up of the engine/engine oil/automatic transmission oil and the EGR usage time point and improves heating performance.

Description of Related Art

In general, simultaneously satisfying both high fuel economy and high performance is a representative trade-off problem of the fuel economy-performance of gasoline-diesel vehicles. One method for solving the trade-off problem is, for example, to improve the performance of a Vehicle Thermal Management System (VTMS).

The reason to solve the trade-off problem by improving the VTMS is because the VTMS may be constructed to associate an engine cooling system, an Exhaust Gas Recirculation (EGR) system, an Auto Transmission Fluid (ATF) system, and a heater system with an engine. The VTMS may effectively distribute and control high temperature coolant of the engine transmitted to each of the systems according to the vehicle or the engine operating condition, thereby simultaneously satisfying high fuel economy and high performance.

Therefore, the VTMS is a design factor in which the efficiency of an engine coolant distribution control is very important. To this end, some of a plurality of heat exchange systems associated with the engine maintains a high coolant temperature while others maintain a low coolant temperature, such that it is necessary to use an Integrated Thermal Management Valve (ITM) for the coolant distribution control to efficiently control the plurality of heat exchange systems at the same time.

For example, the ITM has an inlet into which the engine coolant flows and has four ports so that the received engine coolant flows out in different directions. The cooling system, the Exhaust Gas Recirculation (EGR) system, the Auto Transmission Fluid (ATF) system, and the heater system may be associated in four ways by four ports, thereby optimizing the heat exchange effect of the engine coolant in which the temperature varies according to the operating state of the engine.

In this case, the cooling system may be a radiator for lowering the engine coolant temperature by exchanging heat with the outside air; the EGR system may be an EGR cooler for lowering the temperature of the EGR gas transmitted to the engine among the exhaust gas by exchanging heat with the engine coolant; the ATF system may be an oil warmer for raising the ATF temperature by exchanging heat with the engine coolant; and the heater system may be a heater core for raising the outside air by exchanging heat with the engine coolant.

Furthermore, the ITM performs an ITM valve opening control by using a temperature detection value of a coolant temperature sensor provided at the coolant inlet/outlet sides of the engine in the respective coolant controls of the EGR cooler, the oil warmer, and the heater core, such that it is more effective to reduce the fuel consumption while enhancing the entire cooling efficiency of the engine.

The contents described in Description of Related Art are to help the understanding of the background of the present disclosure and may include what is not previously known to those of ordinary skill in the art to which the present disclosure pertains.

However, in recent years, fuel economy improvement demands that are further strengthened for gasoline/diesel vehicles require VTMS performance improvement, which leads to the performance improvement demand for an engine coolant distribution control of an ITM.

The reason for the performance improvement demand is because the ITM may further enhance the efficiency of the engine coolant distribution control by changing an ITM layout that connects an engine and a system.

For example, the ITM layout is more effective to be configured to firstly enable a variable flow pattern control of engine coolant in an engine, to secondly enable the position optimization of any one among the cooling/EGR/ATF/heater systems, and to thirdly enable the optimization of the exhaust heat recovery control performance.

SUMMARY OF THE DISCLOSURE

Therefore, an object of the present disclosure considering the above point is to provide a vehicle thermal management system that applies a layer ball type integrated thermal management valve and a cooling circuit control method thereof, which may apply a layer valve body to the integrated thermal management valve. Thereby, the ITM layout capable of a variable flow pattern control of the engine coolant in the engine, the optimal position selection of the engine-associated system, and the exhaust heat recovery optimal control are implemented. In particular, the vehicle thermal management system and the cooling circuit control method may associate an Exhaust Heat Recovery System (EHRS) in the four-port ITM layout, thereby simultaneously improving fuel economy and heating performance by shortening the EGR usage time point while quickly implementing the warm-up of the engine and the engine oil/ATF oil at the same time.

A vehicle thermal management system according to the present disclosure for achieving the object includes: an ITM for receiving engine coolant through a coolant inlet connected to an engine coolant outlet of an engine, and distributing the engine coolant flowing out toward a radiator through a coolant outlet flow path connected to a heat exchange system including at least one among a heater core, an EGR cooler, an oil warmer, and an ATF warmer and the radiator; a water pump positioned at the front end of the engine coolant inlet of the engine; and a coolant branch flow path branched at the front end of the engine coolant inlet to be connected to the coolant outlet flow path.

In an embodiment, an EHRS may be installed at the coolant branch flow path.

In an embodiment, the coolant outlet flow path may be composed of a radiator outlet flow path connected to the radiator, a first distribution flow path connected to the heater core or the EGR cooler, and a second distribution flow path connected to the oil warmer or the ATF warmer.

In an embodiment, the second distribution flow path may be connected with the coolant branch flow path.

In an embodiment, the first distribution flow path may form a leak hole, out of which some flow is supplied to an EGR cooler directional outlet flow path port.

In an embodiment, the engine coolant outlet may include an engine head coolant outlet and an engine block coolant outlet. The coolant inlet may include an engine head coolant inlet connected with the engine head coolant outlet and an engine block coolant inlet connected with the engine block coolant outlet.

In an embodiment, the valve opening of the ITM may form the opening or closing of the engine head coolant inlet and the engine block coolant inlet oppositely.

In an embodiment, the opening of the engine head coolant inlet may form a Parallel Flow, in which the coolant flows out to the engine head coolant outlet, inside an engine. The opening of the engine block coolant inlet may form a Cross Flow, in which the coolant flows out to the engine block coolant outlet, inside an engine.

Further, a cooling circuit control method of a vehicle thermal management system according to the present disclosure includes: distributing the coolant flowing out toward a radiator through a radiator outlet flow path of a coolant outlet flow path to a heat exchange system including at least one among a heater core, an EGR cooler, an oil warmer, an ATF warmer, and an EHRS by flowing the coolant of an engine circulated to a water pump and a radiator from an ITM into an engine head coolant inlet and an engine block coolant inlet, and joining the engine coolant having passed through the EHRS in a coolant branch flow path branched from the water pump side to be connected to the coolant outlet flow path; adjusting a coolant flow of the coolant branch flow path connected to a second distribution flow path of the coolant outlet flow path connected to the oil warmer or the ATF warmer; and performing any one among a STATE 1, a STATE 2, a STATE 3, a STATE 4, a STATE 5, a STATE 6, a STATE 7, and a STATE 8 as an engine coolant control mode of a vehicle thermal management system under a valve opening control of the ITM by a valve controller.

In an embodiment, the valve controller may determine the operating condition with vehicle operating information detected through a vehicle thermal management system. The operating condition may be applied as a transition condition for switching a STATE while determining an operation of controlling the STATE 1, the STATE 2, the STATE 3, the STATE 4, the STATE 5, the STATE 6, the STATE 7, and the STATE 8.

In an embodiment, in the STATE 1, the ITM may open the engine head coolant inlet while it closes the engine block coolant inlet, the radiator outlet flow path, the first distribution flow path, and the second distribution flow path. The coolant branch flow path may be opened to the oil warmer or the ATF warmer side.

In an embodiment, in the STATE 2, the ITM may partially open the first distribution flow path and the second distribution flow path while opening the engine head coolant inlet while it closes the engine block coolant inlet and the radiator outlet flow path. The coolant branch flow path may be opened to the oil warmer or the ATF warmer side.

In an embodiment, in the STATE 3, the ITM may partially open the second distribution flow path while opening the engine head coolant inlet and the first distribution flow path while it closes the engine block coolant inlet and the radiator outlet flow path. The coolant branch flow path may be opened to the oil warmer or the ATF warmer side.

In an embodiment, in the STATE 4, the ITM may partially open the radiator outlet flow path while opening the engine head coolant inlet, the first distribution flow path, and the second distribution flow path while it closes the engine block coolant inlet. The coolant branch flow path may be opened to the oil warmer or the ATF warmer side.

In an embodiment, in the STATE 5, the ITM may close the engine head coolant inlet while it partially opens the radiator outlet flow path, the first distribution flow path, and the second distribution flow path while opening the engine block coolant inlet. The coolant branch flow path may be closed to the oil warmer or the ATF warmer side.

In an embodiment, in the STATE 6, the ITM may close the engine head coolant inlet while it opens the engine block coolant inlet, the radiator outlet flow path, the first distribution flow path, and the second distribution flow path. The coolant branch flow path may be closest to the oil warmer or the ATF warmer side.

In an embodiment, in the STATE 7, the ITM may close the engine head coolant inlet, the radiator outlet flow path, and the second distribution flow path while it opens the engine block coolant inlet and the first distribution flow path. The coolant branch flow path may be closed to the oil warmer or the ATF warmer side.

In an embodiment, the controlling of each of the STATE 1-STATE 8 may be determined by the operating condition of the vehicle operating information.

In an embodiment, the STATE 1-STATE 4 may form a Parallel Flow inside the engine by opening the engine head coolant inlet and closing the engine block coolant inlet. The Parallel Flow may use the engine head coolant outlet, through which the coolant is communicated with the engine head coolant inlet, as a main circulation passage.

In an embodiment, the STATE 5-STATE 7 may form a Cross Flow inside the engine by opening the engine block coolant inlet and closing the engine head coolant inlet. The Cross Flow may use the engine block coolant outlet, through which the coolant is communicated with the engine block coolant inlet, as a main circulation passage.

In an embodiment, the valve controller may open the valve opening of the ITM to a maximum cooling position by applying the STATE 8 as the engine control mode at the engine stop.

Further, an integrated thermal management valve according to the present disclosure flows in and out engine coolant flowing out from an engine by the rotation of first, second, and third layer balls inside a valve housing. The valve housing includes: a housing heater port forming a second direction flow path flowing out the engine coolant to an EGR cooler or a heater core side; an oil warmer port forming a third direction flow path flowing out to an oil warmer or an ATF warmer side; and a radiator port forming a first direction flow path flowing out to a radiator side.

In an embodiment, the first layer ball and the second layer ball may flow the engine coolant from the inside of the valve housing to the outside thereof. The third layer ball may flow the engine coolant from the outside of the valve housing to the inside thereof.

In an embodiment, the first layer ball may form a channel flow path communicated with the oil warmer port. The second layer ball may form a channel flow path communicated with the heater port. The third layer ball may form a channel flow path communicated with the radiator outlet.

In an embodiment, the channel flow path of the third layer ball may be formed in a shape having one end tapered toward the channel end. The channel flow path may form a head flow path in the head direction through an engine head coolant inlet connected to an engine head coolant outlet of the engine, and a block flow path in the block direction through an engine block coolant inlet connected to an engine block coolant outlet of the engine. The opening and closing of the head directional flow path and the block directional flow path may be formed oppositely from each other.

In an embodiment, the first layer ball, the second layer ball, and the third layer ball may be rotated by an actuator to be controlled by the valve opening of the ITM. The ITM valve opening control may form an engine coolant control mode that applies any one among STATES 1, 2, 3, 4, 5, 6, 7, and 8 as a variable cooling control by changing the opening and closing of the first directional flow path, the second directional flow path, and the third directional flow path.

In an embodiment, the engine coolant control mode may be implemented by performing the ITM valve opening control by a valve controller that uses, as input data, an engine coolant temperature outside an engine detected by a first WTS and an engine coolant temperature inside the engine detected by a second WTS.

The present disclosure has the following advantages by improving the integrated thermal management valve and the vehicle thermal management system at the same time.

For example, operations and effects that occur in the integrated thermal management valve are described below. First, it is possible to constitute the layer ball having a cylindrical structure, thereby implementing the four-port ITM layout capable of the variable flow pattern control of the engine coolant in the engine, the optimal position selection of the engine-associated system, and the exhaust heat recovery optimal control. Second, it is possible to implement the engine fast warm-up in the flow stop control mode of the STATE 1 and the micro flow rate control mode of the STATE 2, and the air-conditioning fast warm-up in the heating control mode of the STATE 3, and the maximum heating control mode of the STATE 7 with respect to the warm-up mode of the STATES 1 and 2 or the STATE 7 among the coolant control mode classified into the STATES 1-8. Third, it is possible to implement the temperature adjustment mode in the temperature adjustment control mode of the STATE 4 and the high speed/high load control mode of the STATE 6 among the coolant control modes classified into the STATES 1-8.

For example, operations and effects that occur in the vehicle thermal management system when applying the ITM layout of the layer ball type integrated thermal management valve are described below. First, it is possible: to improve the fuel economy in the normal load condition by performing the variable flow pattern control in the engine in the Parallel Flow, in which the cylinder block temperature is raised to be an advantage for friction improvement; to improve the knocking in the high load condition in the Cross Flow, in which the cylinder block temperature is lowered; and to improve the performance/fuel economy/durability at the same time by improving the knocking and the friction. Second, it is possible to associate the EHRS with the ITM of the four-port ITM layout, thereby simultaneously improving fuel economy and heating performance by shortening the EGR usage time point while quickly implementing the warm-up of the engine and the engine oil/ATF oil at the same time. Third, it is possible to enable the exhaust heat recovery optimal control. Thereby, the fast warm-up is implemented and the heating performance is enhanced by using the exhaust heat energy of the Exhaust Heat Recovery System (EHRS) to delete the Positive Temperature Coefficient Heater (PTC Heater) to save in costs, and further, to miniaturize the EHRS, thereby improving the weight and the packageability. Furthermore, the warm-up performance of the coolant/engine oil/transmission oil is improved and the merchantability of the vehicle may be enhanced through the grade improvement displayed in the fuel economy label (for example, indication of the energy consumption efficiency grade).

DESCRIPTION OF SPECIFIC EMBODIMENTS

Hereinafter, various embodiments of the present disclosure are described in detail with reference to the accompanying drawings. Since these embodiments may be implemented by those of ordinary skill in the art to which the present disclosure pertains in various different forms, they are not limited to the embodiment described herein.

Figure 1:
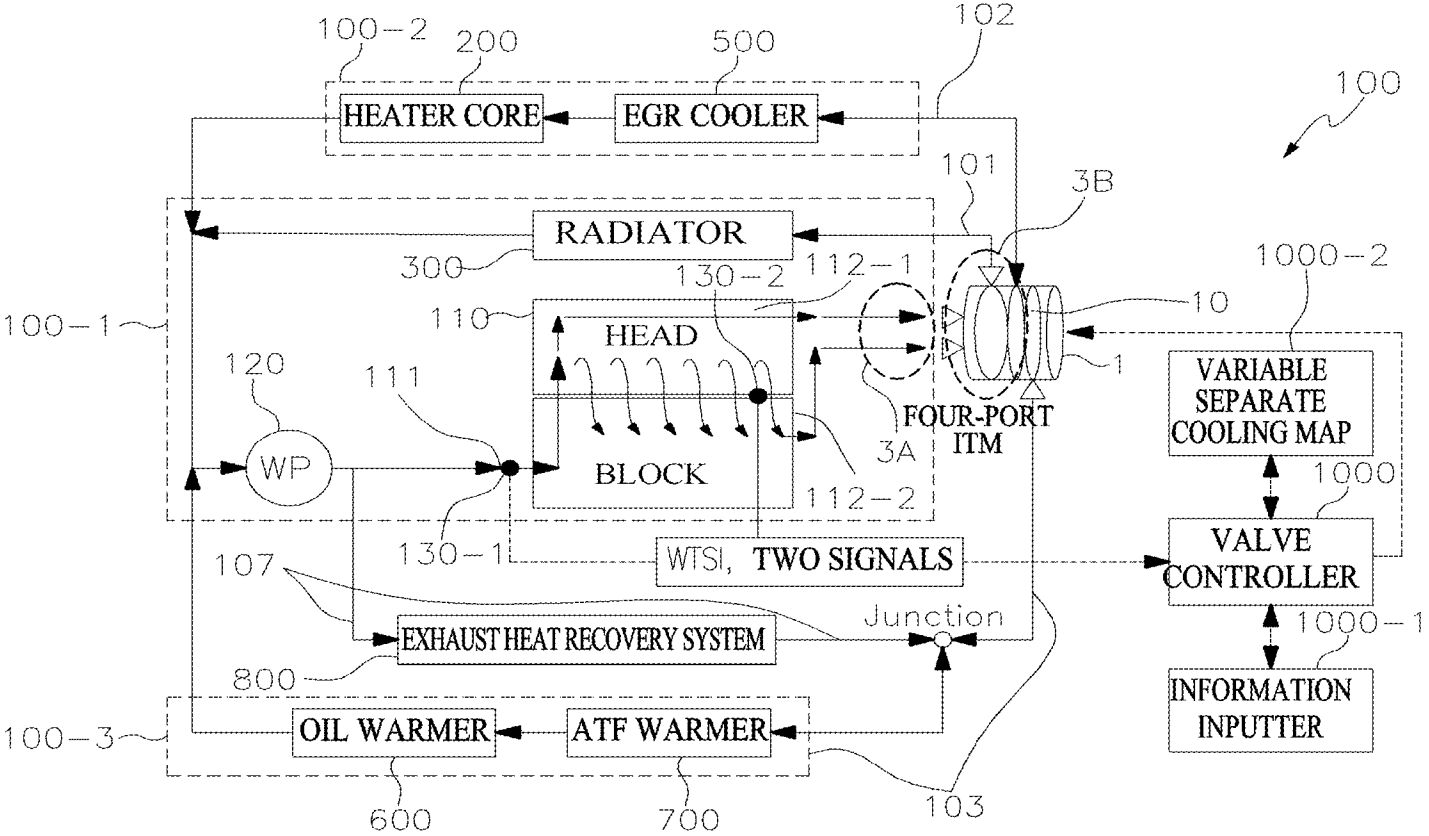
FIG. 1 is a diagram illustrating an example of a vehicle thermal management system applying a layer ball type integrated thermal management valve according to the present disclosure.

Referring to FIG. 1, a Vehicle Thermal Management System (hereinafter referred to as VTMS) 100 includes: an Integrated Thermal Management Valve (hereinafter referred to as ITM) 1 through which engine coolant of an engine 110 flows in and out; a coolant circulation system 100-1 for adjusting the temperature of the engine coolant; a plurality of coolant distribution systems 100-2, 100-3 for optionally distributing the coolant of the ITM 1 to a plurality of heat exchange systems according to an engine operating condition; an Exhaust Heat Recovery System 800 through which exhaust gas of the engine 110 flows; and a valve controller 1000.

In particular, the vehicle thermal management system 100 installs the exhaust heat recovery system 800 at the front end of the engine, and connects the exhaust heat recovery system 800 with a water pump outlet end of a water pump 120 constituting the coolant circulation system 100-1 by a coolant branch flow path 107 to optionally join the engine coolant flowing out from the exhaust heat recovery system 800 to the heat exchange system.

Therefore, the vehicle thermal management system 100 may shorten the EGR usage time point while simultaneously implementing the fast warm-up of the engine and the fast warm-up of the engine oil/ATF oil by using the exhaust heat recovery system 800 at the initial operation of the engine 110. Thereby, heating performance as well as fuel economy is simultaneously improved.

The coolant described below refers to an engine coolant.

Figure 5A:
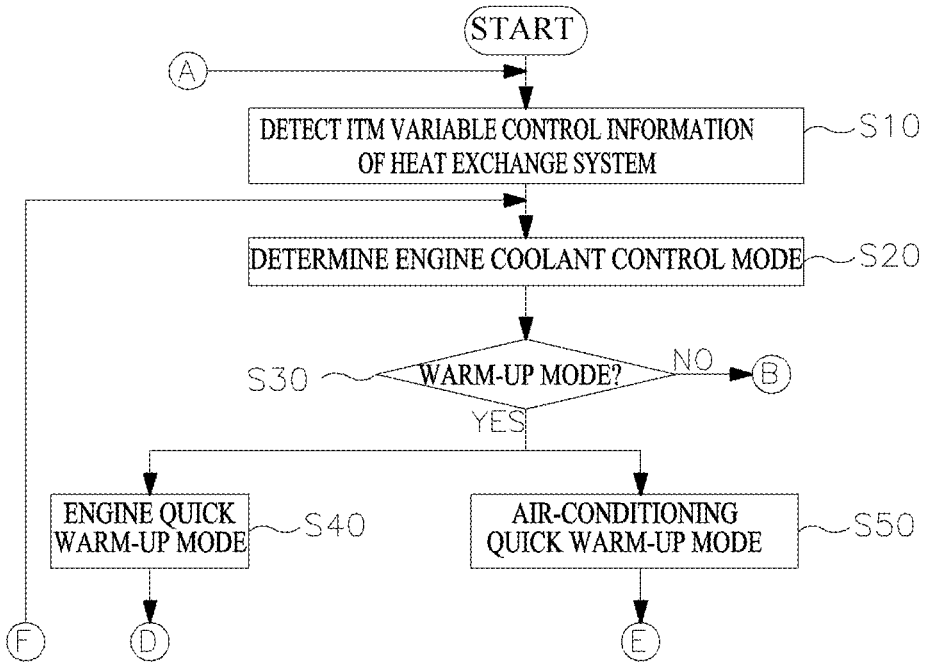
FIGS. 5A, 5B and 6 are operational flowcharts of a cooling circuit control method of a vehicle thermal management system according to the present disclosure.
Figure 5B:
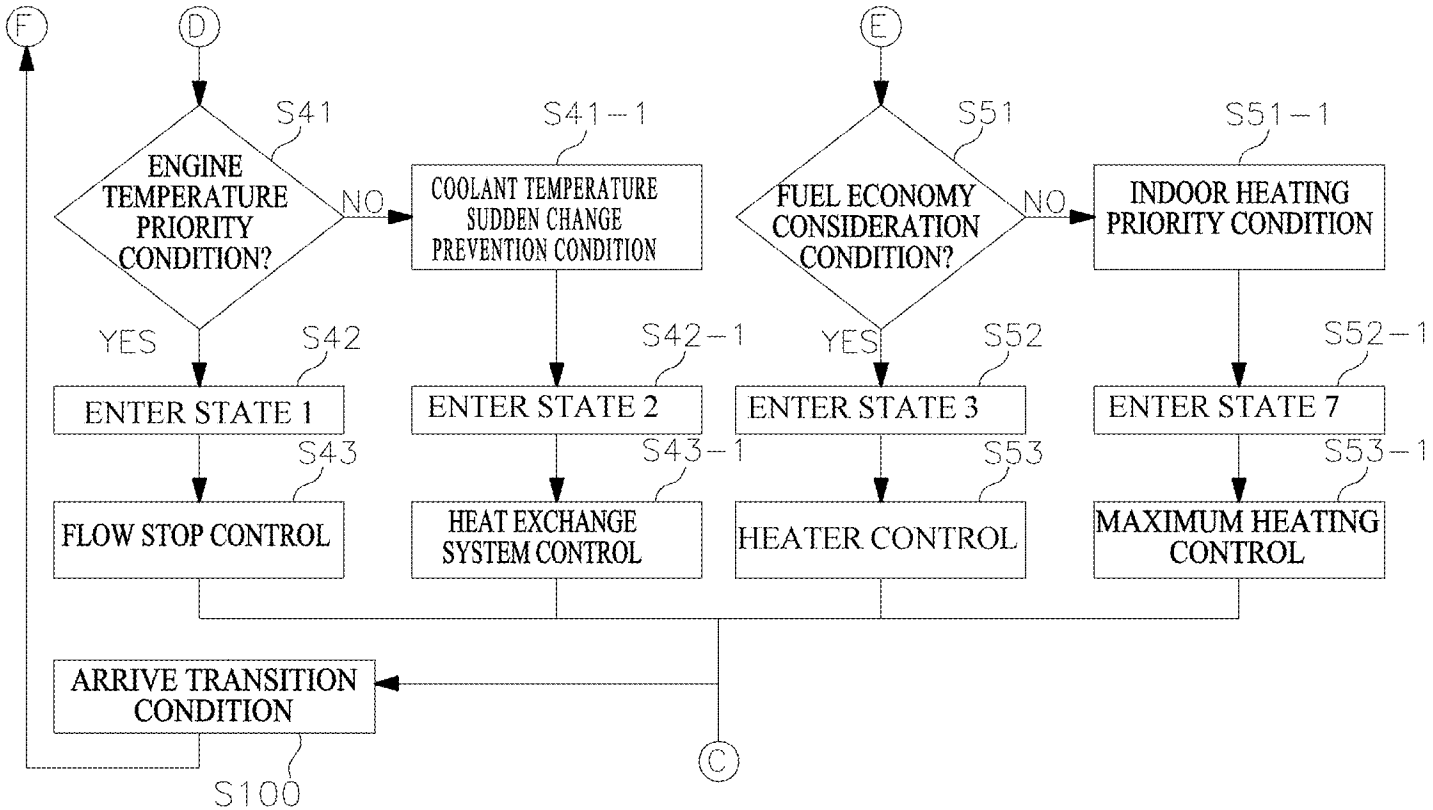

Specifically, the ITM 1 is a four-port configuration of first, second, and third layer balls 10A, 10B, 10C (shown in FIG. 2) constituting a layer ball 10. The ITM 1 associates a coolant control mode (for example, STATES 1-7 in FIGS. 5A, 5B and 6) of the vehicle thermal management system 100 with the exhaust heat recovery system 800 in the same opening condition of the ITM 1 even while performing all functions implemented by the existing four-port ITM. Thereby, heat exchange efficiency together with a fast mode switching are enhanced.

Specifically, the engine 110 is a gasoline engine. The engine 110 forms an engine coolant inlet 111 into which coolant flows in and an engine head coolant outlet 112-1 and an engine block coolant outlet 112-2 in which the coolant flows out. In this example, the engine coolant inlet 111 is connected to a water pump 120 by a first coolant line 101 of the engine cooling system 100-1. The engine head coolant outlet 112-1 is formed at an engine head that includes a cam shaft, a valve system, and the like to be connected with an engine head coolant inlet 3A-1 of the ITM 1. The engine block coolant outlet 112-2 is formed at an engine block that includes a cylinder, a piston, a crankshaft, and the like to be connected with the engine block coolant inlet 3A-2 of the ITM 1.

Furthermore, the engine 110 includes a first Water Temperature Sensor (WTS) 130-1 and a second Water Temperature Sensor (WTS) 130-2. The first WTS 130-1 detects the temperature of the engine coolant inlet 111 side of the engine 110, and the second WTS 130-2 detects the temperature of the engine coolant outlet 112 side of the engine 110, respectively to transmit them to the valve controller 1000.

Specifically, the coolant circulation system 100-1 is composed of the water pump 120 and a radiator 300 and forms a coolant circulation flow of the engine 110 by the first coolant line 101. Further, the coolant circulation system 100-1 is associated with the exhaust heat recovery system 800 positioned at the front end of the engine by connecting the coolant branch flow path 107 to the water pump outlet end of the water pump 120.

For example, the water pump 120 pumps the engine coolant to form the coolant circulation flow. To this end, the water pump 120 applies a mechanic water pump connected with the crankshaft of the block by a belt or a chain to pump the engine coolant to the block side of the engine 110 or applies an electronic waste pump that operates by a control signal of an Electronic Control Unit (ECU). The radiator 300 cools the high temperature coolant flowing out from the engine 110 by exchanging heat with the air. The first coolant line 101 is connected to the radiator outlet flow path 3B-1 of the coolant outlet flow path 3B of the ITM 1 so that the coolant flowing out from the ITM 1 is distributed.

Specifically, the plurality of coolant distribution systems 100-2, 100-3 are classified into the first coolant distribution system 100-2 and the second coolant distribution system 100-3. The heat exchange system is composed of: a heater core 200 for raising the outside air temperature by exchanging heat with the engine coolant; an EGR cooler 500 for lowering the EGR gas temperature transmitted to the engine of the exhaust gas by exchanging heat with the engine coolant; an oil warmer 600 for raising the engine oil temperature by exchanging heat with the engine coolant; and an ATF warmer 700 for raising the ATF temperature (transmission fluid temperature) by exchanging heat with the engine coolant.

For example, the first coolant distribution system 100-2 forms the coolant circulation flow by using the second coolant flow path 102 that associates the heater core 200 and the EGR cooler 500 with the ITM 1. In this case, the heater core 200 and the EGR cooler 500 are arranged in series, and the second coolant line 102 is arranged in parallel with the first coolant line 101. Further, the second coolant flow path 102 is formed in one line by being joined with the first coolant flow path 101 at the inlet of the water pump 120.

In particular, the second coolant flow path 102 is connected with the first distribution flow path 3B-2 of the coolant outlet flow path 3B of the ITM 1 to form the coolant circulation flow by the coolant distribution using a different path from the radiator outlet flow path 3B-1.

Therefore, the first coolant distribution system 100-2 may shorten the EGR usage time point of the EGR cooler 500 by an opening control of the valve controller 1000 while receiving the coolant by the first distribution flow path 3B-2 of the ITM 1. Thereby, fuel economy and heating performance of the heater core 200 are improved at the same time.

For example, the second coolant distribution system 100-3 forms the coolant circulation flow by the third coolant flow path 103 that associates the oil warmer 600 and the ATF warmer 700 with the ITM 1. In this case, the oil warmer 600 and the ATF warmer 700 are arranged in series. Further, the third coolant flow path 103 is formed in one line by being joined with the first coolant flow path 101 at the inlet of the water pump 120.

In particular, the third coolant flow path 103 is connected with the second distribution flow path 3B-3 of the coolant outlet flow path 3B of the ITM 1 to form the coolant circulation flow by the coolant distribution using a different path from the radiator outlet flow path 3B-1 and the first distribution flow path 3B-2. Furthermore, the third coolant flow path 103 is connected with the coolant branch flow path 107 through a junction, such that the coolant having passed through the exhaust heat recovery system 800 from the water pump 120 is joined with the ATF warmer 700 or the oil warmer 600. In this case, the junction may be provided inside the oil warmer 600 or the ATF warmer 700.

Therefore, the second coolant distribution system 100-3 may shorten the EGR usage time point of the oil warmer 600 and the ATF warmer 700 while simultaneously implementing the fast warm-up of the engine oil/ATF oil by joining the coolant having passed through the exhaust heat recovery system 800 through the coolant branch flow path 107 while receiving the coolant by the first distribution flow path 3B-2 of the ITM 1, thereby improving fuel economy.

Specifically, the valve controller 1000 optionally forms: the coolant flow of the first coolant flow path 101 circulating the radiator 300 of the coolant circulation system 100-1; the coolant flow of the second coolant flow path 102 circulating the heater core 200 and the EGR cooler 500 of the first coolant distribution system 100-2; the coolant flow of the third coolant flow path 103 circulating the oil warmer 600 and the ATF warmer 700 of the second coolant distribution system 100-3; and the coolant join flow of the coolant branch flow path 107 joining with the oil warmer 600 or the ATF warmer 700 in the exhaust heat recovery system 800 under the valve opening control of the ITM 1.

To this end, the valve controller 1000 shares the information of the engine controller (for example, the information inputter 1000-1) for controlling the engine system via CAN and receives temperature detection values of first and second WTSs 130-1, 130-2 to control the valve opening of the ITM 1. In particular, the valve controller 1000 has a memory in which logic or a program matching the coolant control mode (for example, STATES 1-8) (see FIGS. 5A and 5B to 7) has been stored, and outputs the valve opening signal of the ITM 1.

Further, the valve controller 1000 has the information inputter 1000-1, and a variable separation cooling map 1000-2 provided with an ITM map that matches the valve opening of the ITM 1 to the engine coolant temperature condition and the operating condition according to the vehicle information.

In particular, the information inputter 1000-1 detects an IG on/off signal, a vehicle speed, an engine load, an engine temperature, a coolant temperature, a transmission fluid temperature, an outside air temperature, an ITM operating signal, accelerator/brake pedal signals, and the like to provide them as input data of the valve controller 1000. In this case, the vehicle speed, the engine load, the engine temperature, the coolant temperature, the transmission fluid temperature, the outside air temperature, and the like are applied as the operating conditions. Therefore, the information inputter 1000-1 may be an engine controller for controlling the entire engine system.

Figure 2:
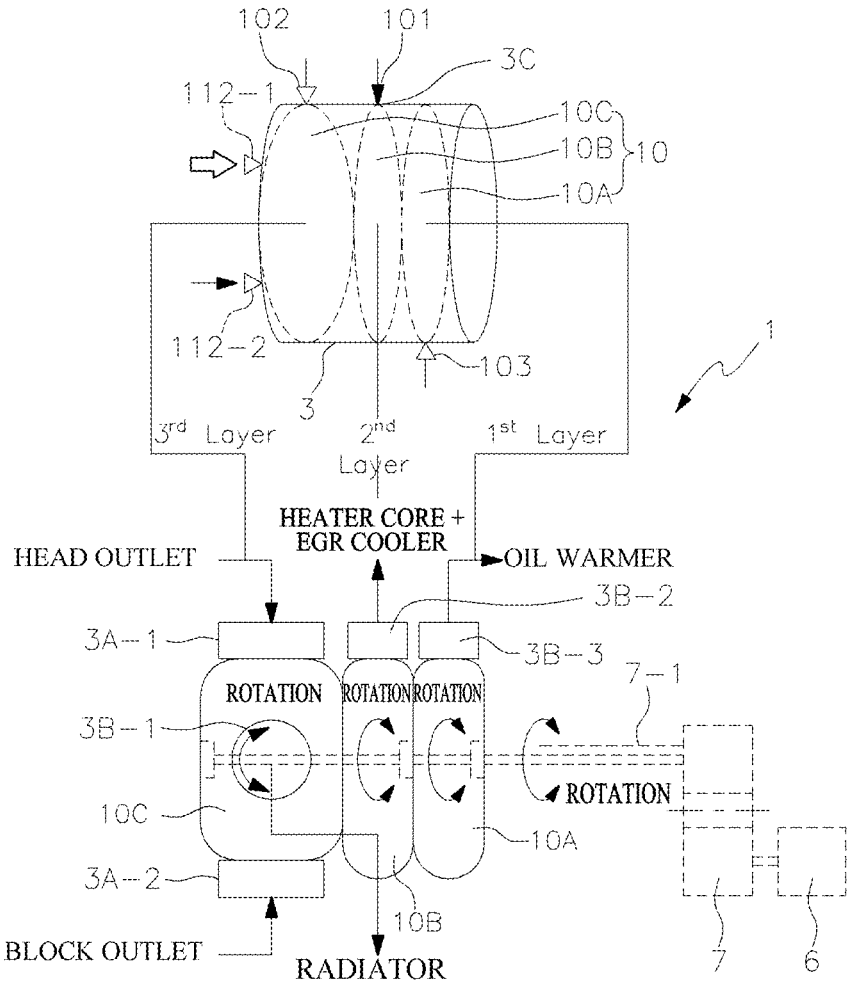
FIG. 2 is a diagram illustrating an example in which a layer ball of the integrated thermal management valve according to the present disclosure constitutes a triple layer as first, second, and third layer balls.
Figure 3:
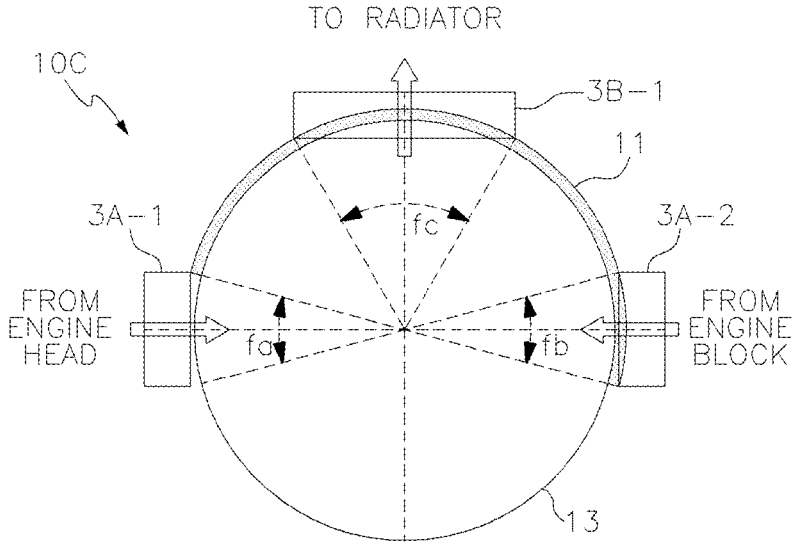
FIG. 3 is a diagram illustrating an example in which the opening/closing of outlet ports of an engine head and an engine block at rotation of the third layer ball according to the present disclosure are applied oppositely.

FIGS. 2 and 3 illustrate a detailed configuration of the ITM 1.

Referring to FIG. 2, the ITM 1 performs an engine coolant distribution control and an engine coolant flow stop control according to a variable separation cooling operation by a combination of the first layer ball 10A, the second layer ball 10B, and the third layer ball 10C constituting the layer ball 10.

In this case, in the four-port layout, the first layer ball 10A is arranged in the rear direction of the vehicle, the third layer ball 10C is arranged in the front direction of the vehicle, and the second layer ball 10B is arranged between the first layer ball 10A and the third layer ball 10C. Therefore, the first layer ball 10A is classified as a first layer, the second layer ball 10B is classified as a second layer, and the third layer ball 10C is classified as a third layer.

Furthermore, the ITM 1 includes a valve housing 3 for accommodating the layer ball 10 and forming four ports, and an actuator 5 for operating the layer ball 10 under the control of the valve controller 1000.

Specifically, the valve housing 3 forms an inner space in which the layer ball 10 is accommodated, and forms four ports through which the engine coolant flows in and out in the inner and outer spaces. The four ports are formed of the coolant inlet 3A forming one port and the coolant outlet flow path 3B forming three ports.

For example, the coolant inlet 3A includes an engine head coolant inlet 3A-1 connected to the engine head coolant outlet 112-1 of the engine 110 and an engine block coolant inlet 3A-2 connected to the engine block coolant outlet 112-2 of the engine 110. Further, the coolant outlet flow path 3B includes a radiator outlet flow path 3B-1 connected with the first coolant line 101 connected to the radiator 300, a first distribution flow path 3B-2 connected with the second coolant flow path 102 connected to the heater core 200 and the EGR cooler 500, and a second distribution flow path 3B-3 connected with the third coolant flow path 103 connected to the oil warmer 600 and the ATF warmer 700.

In particular, the radiator outlet flow path 3B-1 may be formed in a general symmetrical structure for applying a 0-100% variable control unit so that the 100% opening condition of the radiator is partially maintained to set the switching range of the mode for the variable flow pattern control.

Further, the valve housing 3 has a leak hole 3C. The leak hole 3C may flow a small amount of coolant from the first distribution flow path 3B-2 to the second coolant flow path 102 to supply the coolant required in the EGR cooler 500 according to the initial operation of the engine 110, thereby improving the temperature sensitivity. In this case, the leak hole 3C applies an existing setting value to the hole diameter, and the existing setting value applies the diameter of the leak hole 3C of about Φ 1.0 to 3.0 mm that may flow about 1 to 5 LPM (Liter Per Minutes) at a partial flow rate. Thereby, the condensation of the EGR cooler 500 is prevented from occurring at the engine coolant outlet side of the EGR cooler 500.

Specifically, the actuator 5 is connected with a speed reducer 7 by applying a motor. In this case, the motor may be a Direct Current (DC) motor or a Step motor controlled by the valve controller 1000. The speed reducer 7 is composed of a motor gear that is rotated by a motor and a valve gear having a gear shaft 7-1 for rotating the layer ball 10.

Therefore, the actuator 5, the speed reducer 7, and the gear shaft 7-1 have the same configuration and operating structure as those of the general ITM 1. However, there is a difference in that the gear shaft 7-1 is configured to rotate the first layer ball 10A, the second layer ball 10B, and the third layer ball 10C of the layer ball 10 together at the operation of the motor 6 to change a valve opening angle.

Referring to FIG. 3, the third layer ball 10C of the first, second, and third layer balls 10A, 10B, 10C has a channel flow path 13, which oppositely forms the opening of the engine head coolant inlet 3A-1 and the engine block coolant inlet 3A-2, formed by cutting a certain section of the ball body 11 of the hollow sphere, and has the radiator outlet flow path 3B-1 perforated in the ball body 11 in a circular hole. In this case, the channel flow path 13 is formed at about 180° relative to 360° of the ball body 11.

In particular, if the channel flow path 13 is completely opened in a head direction section (fa) of the engine head coolant inlet 3A-1 according to the rotational direction of the ball body 11, the channel flow path 13 is completely blocked in a block direction section (fb) of the engine block coolant inlet 3A-2 or is partially opened in the head direction section (fa) and the block direction section (fb) at the same time, and is opened or partially opened or blocked in a radiator section (fc) of the radiator outlet flow path 3B-1 together with the opening of one side of the heat direction section (fa) or the block direction section (fb) so that the coolant flowing into the engine head coolant inlet 3A-1 or the engine block coolant inlet 3A-2 flows out from the third layer ball 10C to flow into the first and second layer balls 10A, 10B sides.

As a result, the coolant flowing into the first, second, and third layer balls 10A, 10B, 10C flows out from the third layer ball 10C to the first coolant flow path 101, flows out from the second layer ball 10B to the second coolant flow path 102, and flows out from the first layer ball 10A to the third coolant flow path 103.

Figure 4:
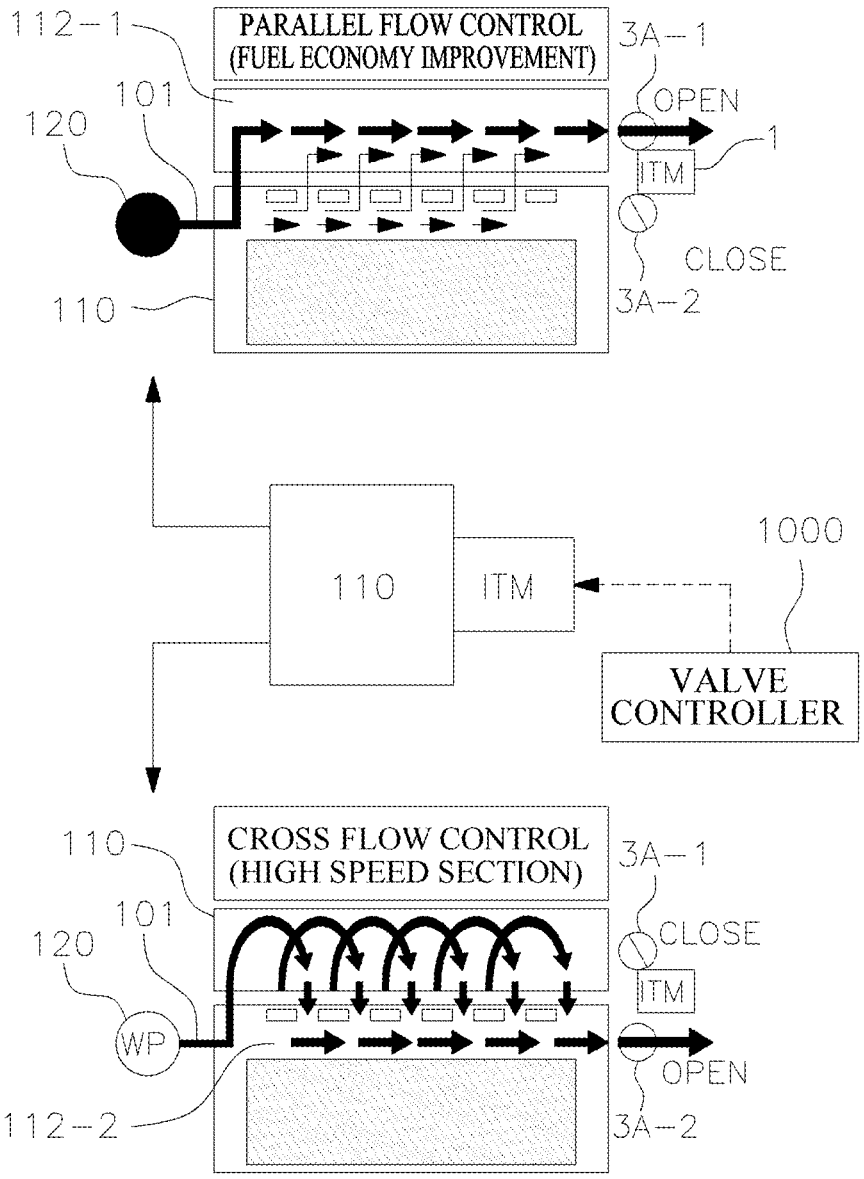
FIG. 4 is a diagram illustrating a state where engine coolant flows out to an ITM while forming a Parallel Flow or a Cross Flow inside an engine by the opposite operation between the outlet ports of the engine head and the engine block according to the present disclosure.

FIG. 4 illustrates an example of a coolant formation pattern of the ITM 1 using the mutual opposite opening or blocking of the engine head coolant inlet 3A-1 and the engine block coolant inlet 3A-2 of the third layer ball 10C. In this case, the coolant formation pattern is classified into a Parallel Flow (Pt) formed in STATES 1-4 of the engine coolant control mode shown in FIG. 7, and a Cross Flow (Cf) formed in STATES 5-7 of the engine coolant control mode shown in FIG. 7.

For example, the Parallel Flow of coolant opens the engine head coolant inlet 3A-1 to communicate with the engine head coolant outlet 112-1 by 100% while it closes the engine block coolant inlet 3A-2 to be blocked from the engine block coolant outlet 112-2 by 100%, thereby, the coolant pattern is formed so that the coolant flows out only to the head side inside the engine 110. In this case, the Parallel Flow raises the block temperature of the engine 110, thereby improving fuel economy.

For example, the Cross Flow of the coolant opens the engine block coolant inlet 3A-2 to communicate with the engine block coolant outlet 112-2 by 100% while it closes the engine head coolant inlet 3A-1 to be blocked from the engine head coolant outlet 112-1 by 100%, thereby the coolant pattern is formed so that the coolant flows out only to the block side inside the engine 110. In this case, the Cross Flow lowers the block temperature of the engine 110, thereby improving knocking and durability.

In particular, the valve opening of the ITM 1 may form a switching range between the Parallel Flow (Pt) and the Cross Flow (Cf). In this case, the switching range maintains the opening of the radiator flow path having the 0 to 100% symmetry setting of the variable control by 100% in a state where the flow path of the first distribution flow path 3B-2 of the second layer ball 10B has continuously maintained the complete opening, thereby being implemented by a coupling control that forms the simultaneous opening section of the head direction section (fa) and the block direction section (fb) of the third layer ball 10C.

Figure 6:
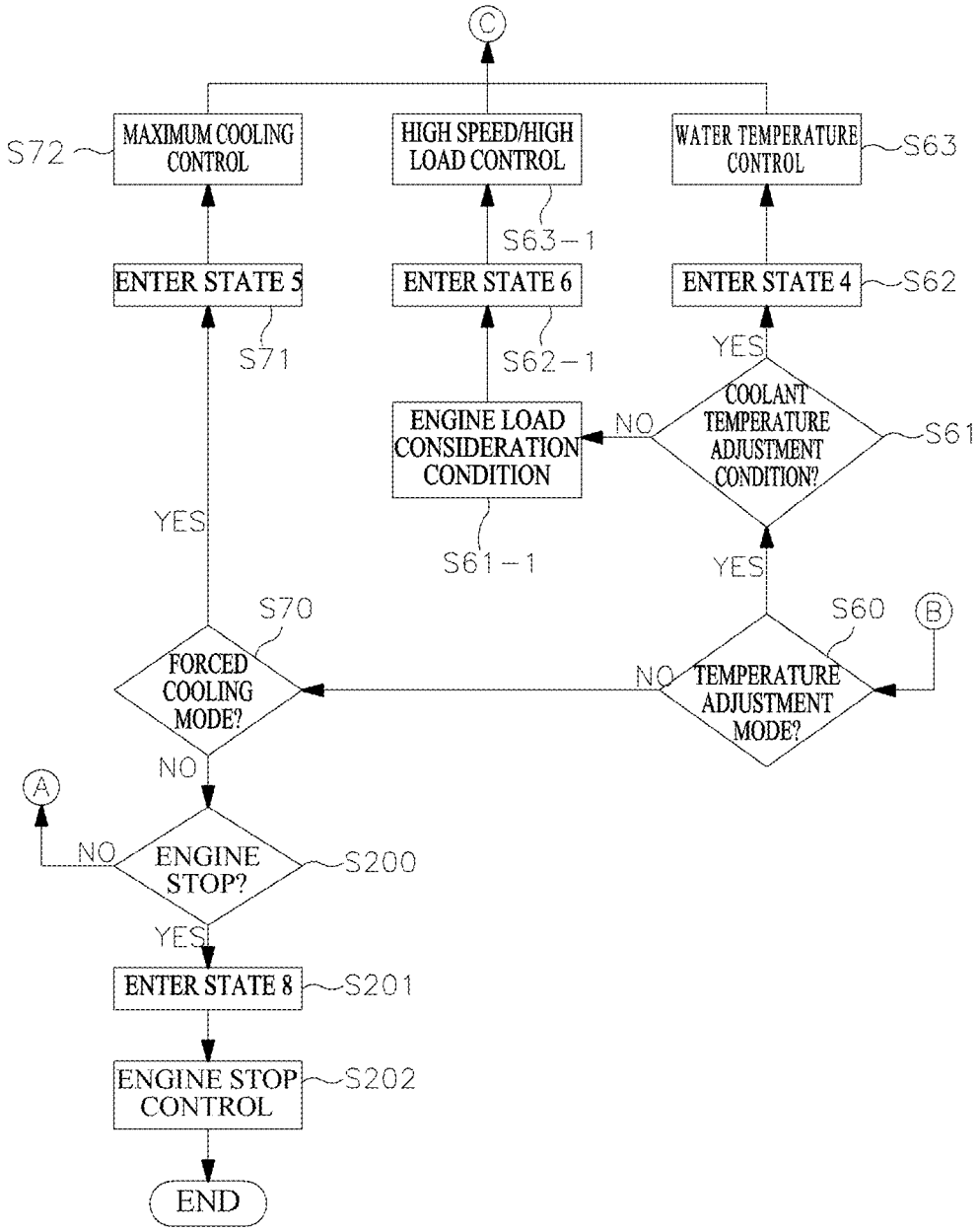
Figure 7:
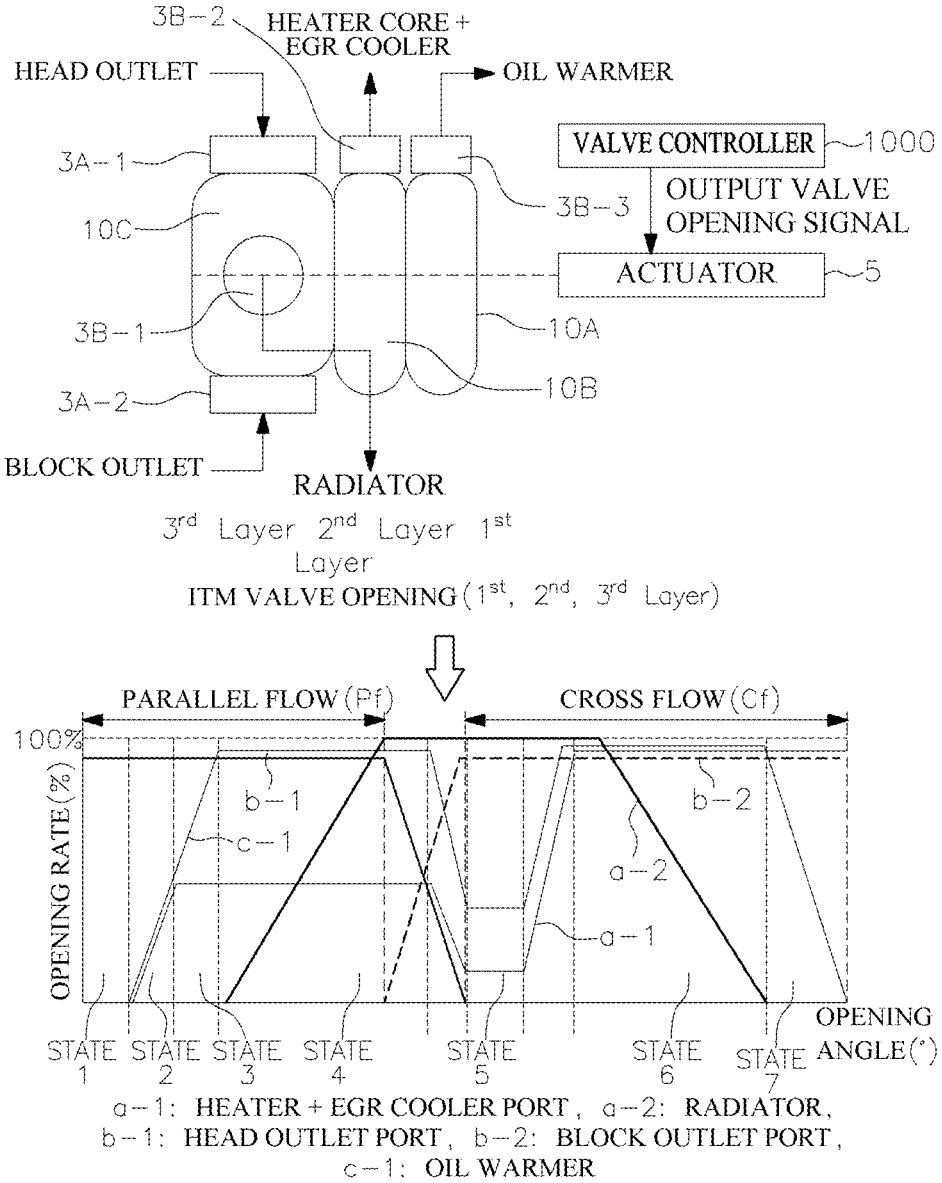
FIG. 7 is a diagram illustrating an ITM control state of a valve controller according to STATES 1-7 of an engine coolant control mode according to the present disclosure.

FIGS. 5-7 illustrate a variable separation cooling control method of a coolant control mode (for example, STATES 1-8) of the vehicle thermal management system 100. In this case, the control subject is the valve controller 1000 and the control target includes the operation of the junction and the heat exchange system in which the direction of the valve is controlled with respect to the ITM 1 in which the valve opening is controlled, respectively.

As illustrated, the cooling circuit control method of the vehicle thermal management system applying the ITM 1 includes determining an engine coolant control mode (S20) by detecting the ITM variable control information of the heat exchange system by the valve controller 1000 (S10) and performing a variable separation cooling valve control (S30-S202). As a result, the vehicle thermal management system control method may simultaneously implement the fast warm-up of the engine and the fast warm-up of the engine oil/transmission fluid (ATF). In particular, the vehicle thermal management control method may improve fuel efficiency and simultaneously improve heating performance by shortening the EGR usage time point.

Specifically, the valve controller 1000 performs the detecting of the ITM variable control information of the heat exchange system (S10) by using, as input data, an IG on/off signal, a vehicle speed, an engine load, an engine temperature, a coolant temperature, a transmission fluid temperature, an outside air temperature, an ITM operating signal, and accelerator/brake pedal signals provided by the information inputter 1000-1. In other words, the operating information of the vehicle thermal management system 100 having the coolant circulation/distribution systems 100-1, 100-2, 100-3, in which the radiator, the EGR cooler, the oil warmer, the ATF warmer, and the EHRS are optionally combined by the valve controller 1000, is detected.

Subsequently, the valve controller 1000 matches the valve opening of the ITM 1 with the engine coolant temperature condition by using the ITM map of the variable separation cooling map 1000-2 with respect to the input data of the information inputter 1000-1, and performs the determining of the engine coolant control mode (S20) therefrom. In this case, the determining of the engine coolant control mode (S20) applies an operating condition. The operating condition is determined by a vehicle speed, an engine load, an engine temperature, a coolant temperature, a transmission fluid temperature, an outside air temperature, and the like to be determined as a state of the different operating condition, respectively, according to its value.

As a result, the valve controller 1000 enters the variable separation cooling valve control (S30-S202). For example, the variable separation cooling valve control (S30-S202) is classified into a warm-up condition control (S30-S50) and a requirement control (S60-S70) in which the mode is switched by the arrival of a transition condition according to the operating condition (S100), and an engine stop control (S200) according to the engine stop (for example, IG OFF).

Specifically, the valve controller 1000 determines the necessity of the warm-up by applying the warm-up mode (S30) and then enters the engine quick warm-up mode (S40) or the air-conditioning quick warm-up mode (S50) with respect to the warm-up condition control (S30-S50).

For example, the engine quick warm-up mode (S40) is performed by a flow stop control (S43) according to the entry of STATE 1 (S42) in the case of an engine temperature priority condition (S41) while the engine quick warm-up mode (S40) is performed by a heat exchange system control (S43-1) according to the entry of STATE 2 (S42-1) in the case of a coolant temperature sudden change prevention condition (S41-1) rather than the engine temperature priority condition (S41). For example, the air-conditioning quick warm-up mode (S50) is performed by a heater control (S53) according to the entry of STATE 3 (S52) in the case of a fuel economy consideration condition (S51) while it is performed by a maximum heating control (S53-1) according to the entry of STATE 7 (S52-1) in the case of an indoor heating priority condition (S51-1) rather than the fuel economy consideration condition (S51).

Specifically, the valve controller 1000 is classified into the temperature adjustment mode (S60) and the forced cooling mode (S70) with respect to the requirement control (S60 and S70). For example, the temperature adjustment mode (S60) is performed by a water temperature control (S63) according to the entry of STATE 4 (S62) in the case of a coolant temperature adjustment condition (S61) while it is performed by the high speed/high load control (S63-1) according to the entry of STATE 6 (S62-1) in the case of an engine load consideration condition (S61-1) rather than a coolant temperature adjustment condition (S61). For example, the forced cooling mode (S70) is performed by a maximum cooling control (S72) according to the entry of STATE 5 (S71) in the case of the forced cooling mode condition (S70).

Specifically, the valve controller 1000 is performed by the engine stop control (S202) according to the entry of STATE 8 (S201) with respect to the engine stop control (S200).

Hereinafter, the operation of the vehicle thermal management system 100 in each of the STATES 1-8 is described below.

For example, the STATE 1 (S42) stops the flow of the engine coolant flowing through the engine 110 until arriving the flow stop release temperature, thereby raising the engine temperature as quickly as possible. In this case, the arrival of the engine temperature condition that arrives the flow stop release temperature beyond the cold start due to the rise in the coolant temperature, or the high speed/high load condition of the rapid acceleration according to the depression of the accelerator pedal with respect to the stop of the STATE 1 (S41) is set to the transition condition 100.

For example, the STATE 2 (S42-1) converges the smoothed temperature up to a target coolant temperature (for example, a warm-up temperature), thereby reducing the temperature fluctuation of the engine coolant after the flow stop release according to the switching of the STATE 1 (S42). In this case, the arrival of the micro flow rate control condition of the engine coolant flow rate with respect to the stop of the STATE 2 (S42-1) is set to the transition condition 100.

For example, the STATE 3 (S51) performs the flow rate control of the heater core 200 side in a flow rate maximum condition of the oil warmer 600 side in a temperature adjustment section (for example, a fuel economy section) after the warm-up of the engine 110 (however, the heater control section is used at the warm-up before the heater is turned on). In this case, an initial coolant temperature/outside air temperature of a constant temperature or more (that is, a fuel economy priority mode switchable temperature), a coolant temperature threshold or more, and a heater operation (heater on) with respect to the stop of the STATE 3 (S51) are set to the transition condition 100. In this example, the coolant temperature threshold is set to a value that exceeds the warm-up temperature.

For example, the STATE 4 (S62) adjusts the engine coolant temperature of the engine 110 according to the target coolant temperature. In this case, the arrival of the condition of the coolant temperature threshold or more calculated by being matched with the outlet temperature of the radiator 300 with respect to the STATE 4 (S62) is set to the transition condition 100.

For example, the STATE 5 (S71) reduces the engine coolant flow rate of the heater core 200 required for a cooling/heating control to a minimum flow rate while maintaining the engine coolant flow rates of the oil warmer 600 and the ATF warmer 700 at an appropriate amount, thereby maximally ensuring cooling capability under the high load condition and the uphill condition. In this case, the arrival of the condition of setting the engine coolant temperature of about 110° C. to 115° C. or more to the coolant temperature threshold with respect to the STATE 5 (S71) is set to the transition condition 100.

For example, the STATE 6 (S62-1) performs the coolant temperature adjustment of the engine 110 in the variable separation cooling release condition. In this case, the arrival of the conditions of the high speed/high load operating data of the engine 110 (for example, the result value matched with the variable separation cooling map 1000-2) and the coolant temperature threshold or more with respect to the STATE 6 (S62-1) is set to the transition condition 100. However, it is more limited to frequently change from the STATE 6 state to other STATES by actually applying the hysteresis and/or the response delay time of the ITM 1. In this example, the coolant temperature threshold is set to a value that exceeds the warm-up temperature.

For example, the STATE 7 (S52-1) flows the engine coolant only to the heater core 200 considering low outside air temperature and initial coolant temperature in the heating operating mode of the heater during the warm-up of the engine 110 and reflects the rise in the temperature of the engine coolant to gradually flow the engine coolant to the oil warmer 600, thereby maximally ensuring the heating capability. In this case, the arrival of the engine coolant temperature condition of the coolant temperature threshold or more after exceeding the warm-up temperature with respect to the STATE 7 (S52-1) is set to the transition condition 100 moving to the STATE 3 (S52).

For example, since the engine 110 is in the engine stop (IG off) state, the STATE 8 (S201) is switched to a state where the ITM 1 has been opened by the valve controller 1000 at the maximum cooling position.

Referring to FIG. 7, the valve opening control of the ITM 1 of the valve controller 1000 for the STATES 1-7 of the engine coolant control mode is illustrated.

In the STATE 1, the valve opening of the ITM 1 closes the radiator outlet flow path 3B-1, the first distribution flow path 3B-2, and the second distribution flow path 3B-3 while opening the engine head coolant inlet 3A-1 and closing the engine block coolant inlet 3A-2. Further, the junction opens the coolant branch flow path 107 to the oil line (i.e., the oil warmer 600 or the ATF warmer 700) side.

As a result, the ITM 1 flows a small amount of coolant to the EGR cooler 500 side through the leak hole 3C while raising the engine temperature as quickly as possible until arriving to the coolant flow stop release temperature in the Parallel Flow, thereby improving the temperature sensitivity of the EGR cooler 500. Further, the junction flows the high temperature coolant heated in the exhaust heat recovery system 800, which is in the exhaust flow state, to the oil warmer 600 or the ATF warmer 700 side, thereby increasing the flow rate of the coolant flowing through the oil warmer 600 or the ATF warmer 700 at the initial start before the warm-up.

In the STATE 2, the valve opening of the ITM 1 closes the radiator outlet flow path 3B-1 while opening the engine head coolant inlet 3A-1 and closing the engine block coolant inlet 3A-2 while it partially opens the first distribution flow path 3B-2 and the second distribution flow path 3B-3. Further, the junction opens the coolant branch flow path 107 to the oil line side.

As a result, the ITM 1 converges the smoothed temperature up to the target coolant temperature (for example, the warm-up temperature) in the Parallel Flow, thereby reducing the temperature fluctuation of the engine coolant after the flow stop release according to the switching of the STATE 1 (S42). Further, the junction flows the high temperature coolant heated in the exhaust heat recovery system 800, which is in the exhaust flow state, to the oil warmer 600 or the ATF warmer 700 side, thereby increasing the flow rate of the coolant flowing through the oil warmer 600 or the ATF warmer 700 after the initial start.

In the STATE 3, the valve opening of the ITM 1 closes the radiator outlet flow path 3B-1 while opening the engine head coolant inlet 3A-1 and closing the engine block coolant inlet 3A-2 while it opens the first distribution flow path 3B-2 and partially opens the second distribution flow path 3B-3. Further, the junction opens the coolant branch flow path 107 to the oil line side.

As a result, the ITM 1 performs the flow rate control of the heater core 200 side in the maximum flow rate condition of the oil warmer 600 side in a temperature adjustment section (for example, a fuel economy section) after the warm-up in the Parallel Flow (however, the heater control section is used at the warm-up before the heater is turned on). Further, the junction flows the high temperature coolant heated in the exhaust heat recovery system 800, which is in the exhaust flow state, to the oil warmer 600 or the ATF warmer 700 side, thereby increasing the flow rate of the coolant flowing through the oil warmer 600 or the ATF warmer 700 after the initial start.

In the STATE 4, the valve opening of the ITM 1 opens the first distribution flow path 3B-2 and the second distribution flow path 3B-3 together with partially opening the radiator outlet flow path 3B-1 while opening the engine head coolant inlet 3A-1 and closing the engine block coolant inlet 3A-2. Further, the junction opens the coolant branch flow path 107 to the oil line side.

As a result, the ITM 1 adjusts the engine coolant temperature according to the target coolant temperature in the Parallel Flow. Further, the junction flows the coolant flowing out from the exhaust heat recovery system 800, which is in the exhaust flow blocking state, without heating to the oil warmer 600 or the ATF warmer 700 side, thereby increasing the flow rate of the coolant flowing through the oil warmer 600 or the ATF warmer 700 after the initial start.

In the STATE 5, the valve opening of the ITM 1 partially opens the first distribution flow path 3B-2 and the second distribution flow path 3B-3 together with partially opening the radiator outlet flow path 3B-1 while closing the engine head coolant inlet 3A-1 and opening the engine block coolant inlet 3A-2. Further, the junction closes the coolant branch flow path 107 to the oil line side.

As a result, the ITM 1 reduces the engine coolant flow rate of the heater core 200 required for the cooling/heating control to a minimum flow rate while maintaining the engine coolant flow rates of the oil warmer 600 and the ATF warmer 700 at an appropriate amount in the Cross Flow, thereby maximally ensuring the cooling capability in the high load condition and the uphill condition. Further, the junction circulates the coolant flowing out from the exhaust heat recovery system 800, which is in the exhaust flow blocking state, without heating to the engine 110 side without transmitting it to the oil warmer 600 or the ATF warmer 700 side. However, the junction may partially open the coolant branch line 107 to flow a minimum flow rate to the oil warmer 600 or the ATF warmer 700 side.

In the STATE 6, the valve opening of the ITM 1 opens the radiator outlet flow path 3B-1, the first distribution flow path 3B-2, and the second distribution flow path 3B-3 while closing the engine head coolant inlet 3A-1 and opening the engine block coolant inlet 3A-2. Further, the junction closes the coolant branch flow path 107 to the oil line side.

As a result, the ITM 1 performs a block temperature downward control with respect to the engine block in the Cross Flow. Further, the junction circulates the coolant flowing out from the exhaust heat recovery system 800, which is in the exhaust flow blocking state, without heating to the engine 110 side without transmitting it to the oil warmer 600 or the ATF warmer 700 side. However, the junction may partially open the coolant branch line 107 to flow a minimum flow rate to the oil warmer 600 or the ATF warmer 700 side.

In the STATE 7, the valve opening of the ITM 1 opens the first distribution flow path 3B-2 and closes the second distribution flow path 3B-3 together with closing the radiator outlet flow path 3B-1 while closing the engine head coolant inlet 3A-1 and opening the engine block coolant inlet 3A-2. Further, the junction closes the coolant branch flow path 107 to the oil line side.

As a result, the ITM 1 flows the engine coolant only to the heater core 200 considering the low outside air temperature and the initial coolant temperature in the heating operating mode of the heater during the warm-up of the engine 110 in the Cross Flow and reflects the rise in the temperature of the engine coolant to gradually flow the engine coolant to the oil warmer 600, thereby maximally ensuring the heating capability. Further, the junction circulates the coolant flowing out from the exhaust heat recovery system 800, which is in the exhaust flow blocking state, without heating to the engine 110 side without transmitting it to the oil warmer 600 or the ATF warmer 700 side. However, the junction may partially open the coolant branch line 107 to flow a minimum flow rate toward the oil warmer 600 or the ATF warmer 700 side.

As described above, the vehicle thermal management system 100 according to the present embodiment includes the plurality of coolant circulation/distribution systems 100-1, 100-2, 100-3 forming the engine coolant flow, which circulates the engine 110 optionally via the heater core 200, the radiator 300, the EGR cooler 500, the oil warmer 600, the ATF warmer 700, and the EHRS 800, in association with the ITM 1. Thereby, fuel economy and heating performance are simultaneously improved by shortening the EGR usage time point while quickly implementing the warm-up of the engine and the ATF oil/engine oil at the same time through the four-port ITM layout of the ITM 1.

What is claimed is:

1. A vehicle thermal management system, comprising:

an Integrated Thermal Management Valve (ITM) for receiving engine coolant through an engine coolant inlet connected to an engine coolant outlet of an engine, and distributing the engine coolant flowing out toward a radiator through a coolant outlet flow path connected to a heat exchange system comprising at least one among a heater core, an Exhaust Gas Recirculation (EGR) cooler, an oil warmer, and an Auto Transmission Fluid (ATF) warmer, and the radiator;

a water pump positioned at a front end of the engine coolant inlet of the engine; and a coolant branch flow path branched at the front end of the engine coolant inlet to be connected to the coolant outlet flow path, wherein an Exhaust Heat Recovery System (EHRS) is installed at the coolant branch flow path, and wherein the coolant outlet flow path comprises a radiator outlet flow path connected to the radiator, a first distribution flow path connected to the heater core or the EGR cooler, and a second distribution flow path connected to the oil warmer or the ATF warmer.

2. The vehicle thermal management system of claim 1, wherein the second distribution flow path is connected with the coolant branch flow path.

3. The vehicle thermal management system of claim 1, wherein the first distribution flow path forms a leak hole, out of which some flow is supplied to an EGR cooler directional outlet flow path port.

4. The vehicle thermal management system of claim 1, wherein the engine coolant outlet comprises an engine head coolant outlet and an engine block coolant outlet, and the coolant inlet comprises an engine head coolant inlet connected with the engine head coolant outlet and an engine block coolant inlet connected with the engine block coolant outlet.

5. The vehicle thermal management system of claim 4, wherein the valve opening of the ITM forms the opening or closing of the engine head coolant inlet and the engine block coolant inlet oppositely.

6. The vehicle thermal management system of claim 5, wherein the opening of the engine head coolant inlet forms a Parallel Flow, in which the coolant flows out to the engine head coolant outlet, inside an engine, and the opening of the engine block coolant inlet forms a Cross Flow, in which the coolant flows out to the engine block coolant outlet, inside an engine.

7. A cooling circuit control method of a vehicle thermal management system, the cooling circuit control method comprising:

distributing a coolant flowing out toward a radiator through a radiator outlet flow path of a coolant outlet flow path to a heat exchange system comprising at least one among a heater core, an Exhaust Gas Recirculation (EGR) cooler, an oil warmer, an Auto Transmission Fluid (ATF) warmer, and an Exhaust Heat Recovery System (EHRS) by flowing the coolant of an engine circulated to a water pump and a radiator from an Integrated Thermal Management Valve (ITM) into an engine head coolant inlet and an engine block coolant inlet, and joining the coolant having passed through the EHRS in a coolant branch flow path branched from the water pump side to be connected to the coolant outlet flow path;

adjusting a coolant flow of the coolant branch flow path connected to a second distribution flow path of the coolant outlet flow path connected to the oil warmer or the ATF warmer; and performing any one among a STATE 1, a STATE 2, a STATE 3, a STATE 4, a STATE 5, a STATE 6, a STATE 7, and a STATE 8 as an engine coolant control mode of a vehicle thermal management system under a valve opening control of the ITM by a valve controller, wherein the EHRS is installed at the coolant branch flow path, and wherein the coolant outlet flow path comprises the radiator outlet flow path connected to the radiator, a first distribution flow path connected to the heater core or the EGR cooler, and the second distribution flow path connected to the oil warmer or the ATF warmer.

8. The cooling circuit control method of the vehicle thermal management system of claim 7, wherein in the STATE 1, the ITM opens the engine head coolant inlet while it closes the engine block coolant inlet, the radiator outlet flow path, the first distribution flow path, and the second distribution flow path, and the coolant branch flow path is opened to the oil warmer or the ATF warmer side.

9. The cooling circuit control method of the vehicle thermal management system of claim 7, wherein in the STATE 2, the ITM partially opens the first distribution flow path and the second distribution flow path while opening the engine head coolant inlet while it closes the engine block coolant inlet and the radiator outlet flow path, and the coolant branch flow path is opened to the oil warmer or the ATF warmer side.

10. The cooling circuit control method of the vehicle thermal management system of claim 7, wherein in the STATE 3, the ITM partially opens the second distribution flow path while opening the engine head coolant inlet and the first distribution flow path while it closes the engine block coolant inlet and the radiator outlet flow path, and the coolant branch flow path is opened to the oil warmer or the ATF warmer side.

11. The cooling circuit control method of the vehicle thermal management system of claim 7, wherein in the STATE 4, the ITM partially opens the radiator outlet flow path while opening the engine head coolant inlet, the first distribution flow path, and the second distribution flow path while it closes the engine block coolant inlet, and the coolant branch flow path is opened to the oil warmer or the ATF warmer side.

12. The cooling circuit control method of the vehicle thermal management system of claim 7, wherein in the STATE 5, the ITM 1 closes the engine head coolant inlet while it partially opens the radiator outlet flow path, the first distribution flow path, and the second distribution flow path while opening the engine block coolant inlet, and the coolant branch flow path is closed to the oil warmer or the ATF warmer side.

13. The cooling circuit control method of the vehicle thermal management system of claim 7, wherein in the STATE 6, the ITM closes the engine head coolant inlet while it opens the engine block coolant inlet, the radiator outlet flow path, the first distribution flow path, and the second distribution flow path, and the coolant branch flow path is closed to the oil warmer or the ATF warmer side.

14. The cooling circuit control method of the vehicle thermal management system of claim 7, wherein in the STATE 7, the ITM closes the engine head coolant inlet, the radiator outlet flow path, and the second distribution flow path while it opens the engine block coolant inlet and the first distribution flow path, and the coolant branch flow path is closed to the oil warmer or the ATF warmer side.

15. The cooling circuit control method of the vehicle thermal management system of claim 7, wherein the controlling of each of the STATE 1-STATE 8 is determined by the operating condition of the vehicle operating information.

16. The cooling circuit control method of the vehicle thermal management system of claim 7, wherein the STATE 1-STATE 4 form a Parallel Flow inside the engine by opening the engine head coolant inlet and closing the engine block coolant inlet, and the Parallel Flow uses the engine head coolant outlet, through which the coolant is communicated with the engine head coolant inlet, as a main circulation passage.

17. The cooling circuit control method of the vehicle thermal management system of claim 7, wherein the STATE 5-STATE 7 form a Cross Flow inside the engine by opening the engine block coolant inlet and closing the engine head coolant inlet, and the Cross Flow uses the engine block coolant outlet, through which the coolant is communicated with the engine block coolant inlet, as a main circulation passage.

18. The cooling circuit control method of the vehicle thermal management system of claim 7, wherein the valve controller opens the valve opening of the ITM to a maximum cooling position by applying the STATE 8 as the engine coolant control mode at the engine stop.

* * * * *